US007273362B2

(12) United States Patent
Patel et al.

(10) Patent No.: US 7,273,362 B2
(45) Date of Patent: Sep. 25, 2007

(54) SCROLL COMPRESSOR WITH AN ECCENTRIC PIN HAVING A HIGHER CONTACT POINT

(75) Inventors: Tapesh P. Patel, Hotsprings, AR (US); Zili Sun, Arkadelphia, AR (US); Thomas R. Barito, Arkadelphia, AR (US)

(73) Assignee: Scroll Technologies, Arkadelphia, AR (US)

( * ) Notice: Subject to any disclaimer, the term of this patent is extended or adjusted under 35 U.S.C. 154(b) by 94 days.

(21) Appl. No.: 11/175,513

(22) Filed: Jul. 6, 2005

(65) Prior Publication Data

US 2007/0009371 A1 Jan. 11, 2007

(51) Int. Cl.
*F01C 1/02* (2006.01)
*F03C 2/00* (2006.01)

(52) U.S. Cl. ..... 418/55.1; 418/14; 418/55.5; 418/57; 74/570.1

(58) Field of Classification Search ..... 418/55.1–55.6, 418/57, 14; 74/510.1
See application file for complete search history.

(56) References Cited

U.S. PATENT DOCUMENTS

| | | | | |
|---|---|---|---|---|
| 5,222,881 | A * | 6/1993 | Sano et al. | 418/55.5 |
| 5,496,157 | A * | 3/1996 | Shoulders et al. | 418/55.5 |
| 5,496,158 | A * | 3/1996 | Barito et al. | 418/55.5 |
| 6,203,257 | B1 | 3/2001 | Fenocchi | |
| 7,063,522 | B1 * | 6/2006 | Sun | 418/55.5 |

* cited by examiner

*Primary Examiner*—Theresa Trieu
(74) *Attorney, Agent, or Firm*—Carlson, Gaskey & Olds

(57) ABSTRACT

A scroll compressor assembly includes a shaft having an eccentric pin that orbits a first scroll member relative to a second scroll member. The eccentric pin has a length extending from a base end to a distal end, which defines a contact area having a slight crown that engages a slider block. The contact area is moved toward the distal end of the eccentric pin to improve the stability of at least one of the first and second scroll members.

10 Claims, 3 Drawing Sheets

SCROLL COMPRESSOR WITH AN ECCENTRIC PIN HAVING A HIGHER CONTACT POINT

BACKGROUND OF THE INVENTION

This application relates generally to a scroll compressor, and more particularly to a scroll compressor including an eccentric pin having a drive surface with a contact area moved toward a distal end of the eccentric pin to improve stability of an orbiting scroll member.

Scroll compressors are becoming widely utilized in refrigerant compression applications. A scroll compressor typically includes a pair of scroll members that each have a base with a generally spiral wrap extending from the base. During operation, one of the two scroll members orbits relative to the other, which compresses a fluid entrapped between the wraps.

Scroll compressors utilize drive shafts to orbit the scroll member. The drive shaft has an end with an eccentric pin that is displaced from a rotational axis of the drive shaft. The eccentric pin is received within a bore of a slider block, which is further received within a boss in the orbiting scroll member. During rotation of the drive shaft, the eccentric pin engages the slider block, and in combination with an Oldham's coupling, moves the orbiting scroll member through an orbital path. A driving force is created at the point of contact between the eccentric pin and the slider block as the drive shaft rotates to move the orbiting scroll member through the orbital path. In addition, a gas force is created simultaneously with the driving force due to compression of the fluid entrapped between the spiral wraps. The driving force and the gas force face opposite directions and lie in separate planes.

Referring to FIGS. 1 and 1B, an eccentric pin 24 according to the prior art has a generally cylindrical outer surface 30 with a drive surface 38 formed along a length L of the outer surface 30. The drive surface 38 is generally flat with a slight crown 41 located near the middle of the drive surface 38 for providing single line contact with the slider block 26. Typically, the peak of the crown 41 is located on the drive surface 38 at a distance that is less than or equal to approximately 61% of the length L of the eccentric pin 24. The location of the peak of the crown 41 near the middle of the drive surface 38, in combination with the gas and driving forces being in separate planes, results in a large tipping moment of the orbiting scroll member. Disadvantageously, the large tipping moment may result in decreased stability of the orbiting scroll member and reduced compressor efficiency. Further, the tipping of the orbiting scroll member may cause diagonal wear on the drive surface, which moves the single line contact between the eccentric pin and the slider block to a lower position along the length of the drive surface. This increases the tipping moment even more, and may result in greater instability of the orbiting scroll member.

Accordingly, it is desirable to control the placement of the drive surface contact area of the eccentric pin to provide a scroll compressor with a more stable orbiting scroll member.

SUMMARY OF THE INVENTION

A scroll compressor assembly according to the present invention includes a first scroll member and a second scroll member cooperating with the first scroll member to define compression chambers. A boss extends from one of the first and second scroll members and receives a slider block. An eccentric pin is received within the slider block and drives the slider block such that one of the first and second scroll members is caused to orbit relative to the other scroll member.

In one example, the eccentric pin has a length extending from its base end to its distal end. The eccentric pin includes a contact area that engages the slider block. The contact area is positioned at least at a distance greater than 62% of the length of the eccentric pin from the base end. More preferably, the contact area is between 70% and 90% of the length.

The scroll compressor assembly of the present invention utilizes a controlled placement of the drive surface contact area of the eccentric pin to provide a more stable orbiting scroll member.

DETAILED DESCRIPTION OF THE PREFERRED EMBODIMENT

Figure 1:
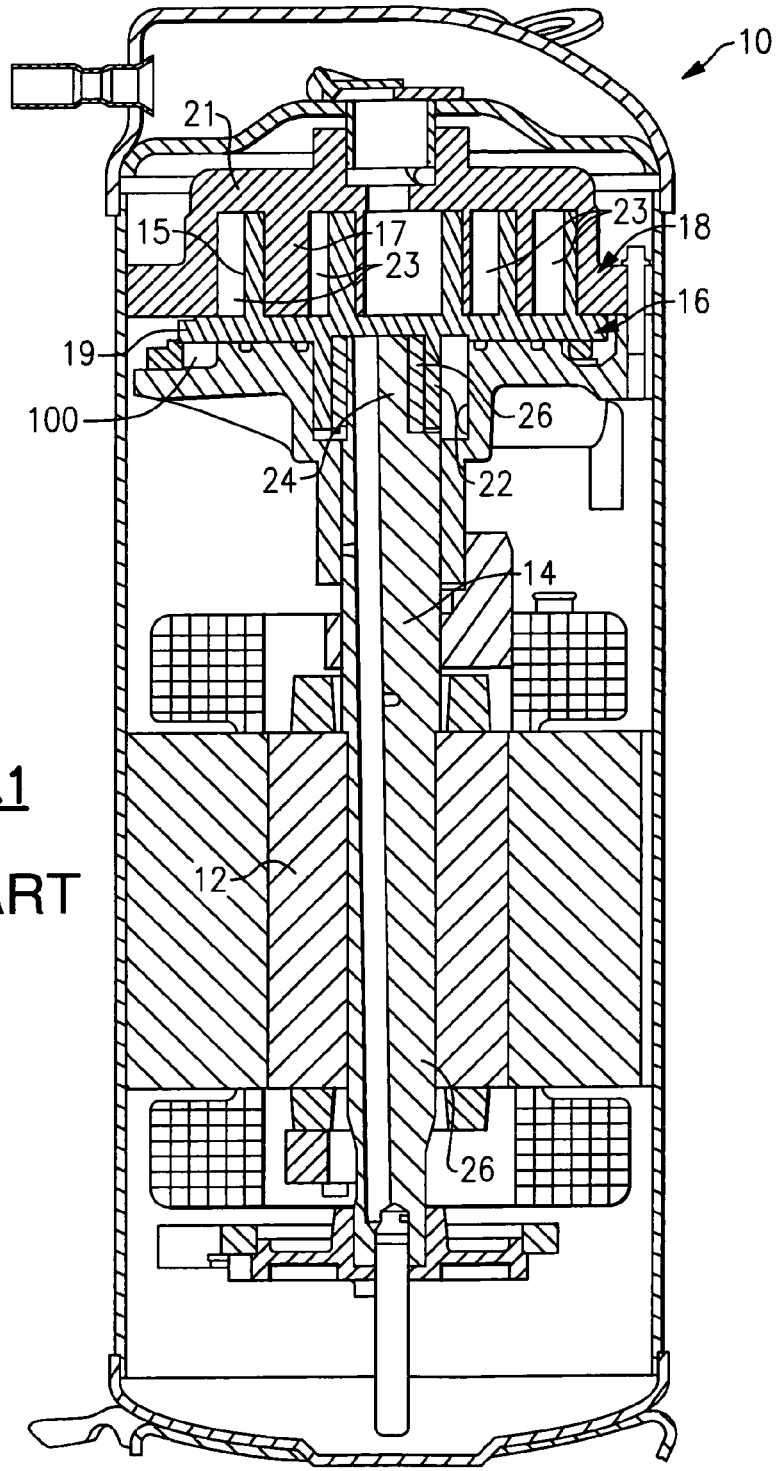
FIG.1 PRIOR ART
FIG. 1 shows a scroll compressor incorporating the present invention.
Figure 1B:
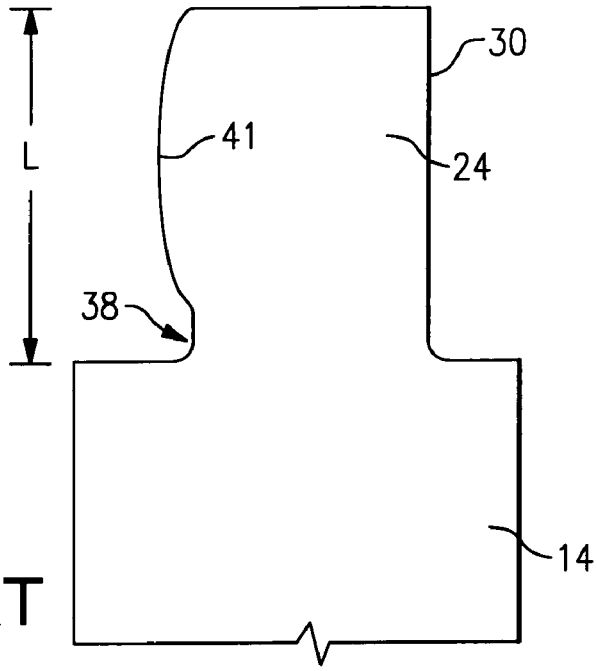
FIG.1B PRIOR ART
FIG. 1B shows an eccentric pin according to the prior art.

An example scroll compressor 10 is illustrated in FIG. 1 having an electric motor 12 for rotating a shaft 14. As known, an orbiting scroll member 16 interfits with a non-orbiting scroll member 18. The scroll members 16 and 18 each have a generally spiral wrap 15 and 17 extending from a base portion 19 and 21. A boss 22 extends downwardly from the orbiting scroll member 16 and receives a slider block 26. An eccentric pin 24 extends axially from the shaft 14 and is received within a bore of the slider block 26. As the shaft 14 rotates, the eccentric pin 24 engages the slider block 26, and in combination with an Oldham's coupling 100, causes the orbiting scroll member 16 to orbit relative to the non-orbiting scroll member 18. The spiral wraps 15 and 17 interfit to define compression chambers 23 that are reduced in volume as the orbiting scroll member 16 is driven by the shaft 14.

Figure 2B:
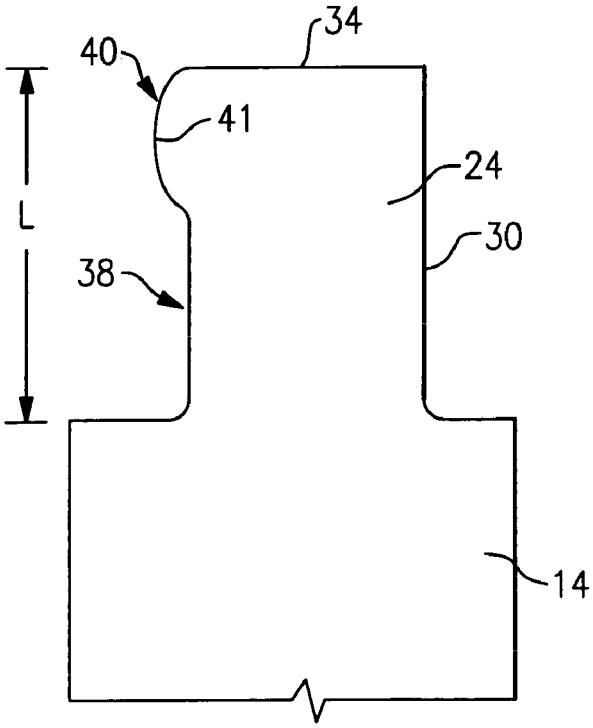
FIG. 2B illustrates a crown location of the eccentric pin according to the present invention.
Figure 2:
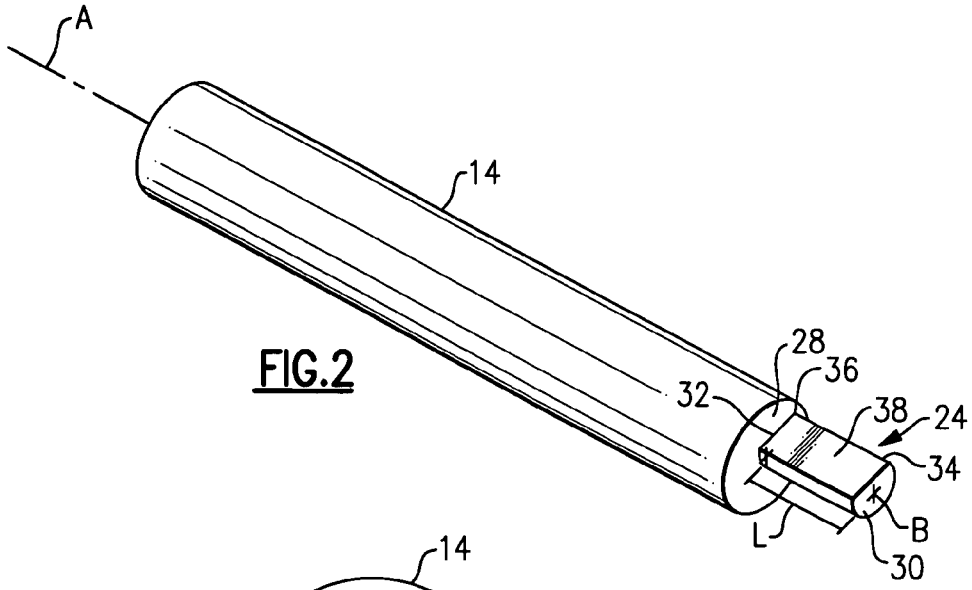
FIG. 2 is a perspective view of a shaft having an eccentric pin with a drive surface according to the present invention.
Figure 3:
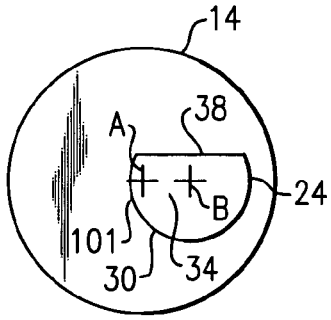
FIG. 3 is an end view of the shaft and the eccentric pin shown in FIG. 1.

Referring to FIG. 2, the shaft 14 has a rotational axis A. The eccentric pin 24 extends axially from an end 28 of the shaft 14. The eccentric pin 24 has an axis B, which is displaced from axis A of the shaft 14 (See FIG. 3). The eccentric pin 24 has an outer surface 30 disposed radially about the axis B. The outer surface 30 includes a length L that extends from a base end 32 to a distal end 34 of the eccentric pin 24. The base end 32 has a smaller cross-sectional area than the end 28 of the shaft 14 such that a shoulder surface 36 is formed between the eccentric pin 24 and the shaft 14.

The eccentric pin 24 includes a drive surface 38 extending along the length L of a portion of the outer surface 30 from the base end 32 to the distal end 34. The drive surface 38 forms a generally flat surface when viewed from the distal end 34 (See FIG. 3). The remaining surface portion 101 of the outer surface 30 has a generally curved profile.

Figure 4:
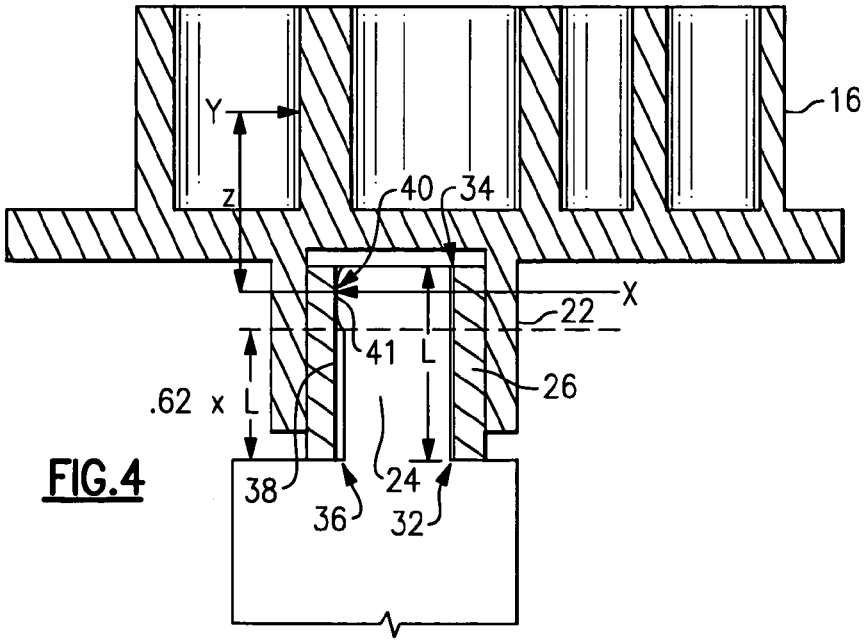
FIG. 4 illustrates an example location of a contact area of the drive surface of the eccentric pin according to the present invention.

Referring to FIG. 2B, the drive surface 38 includes a contact area 40 along the length L of the drive surface 38. The contact area 40 has a slight crown 41 that provides a single line contact between the eccentric pin 24 and the slider block 26 at its peak. Referring to FIG. 4, a drive force X is transmitted at the contact area 40 as the eccentric pin 24 engages the slider block 26 to drive the orbiting scroll member 16. In one example, the the peak of the crown 41 is positioned on the drive surface 38 at least at a distance greater than 62% from the base end 32 of the length L of the eccentric pin 24. Therefore, the contact area 40 is moved closer to the distal end 34 of the eccentric pin 24.

By positioning the peak of the crown 41 at this location, stability of the orbiting scroll member 16 is improved. At distances less than 62% of the length, stability of the orbiting scroll member 16 is adversely affected. Preferably, the peak of the crown 41 is positioned on the drive surface 38 at least at a distance of 75% of the length L from the base end 32 of the eccentric pin 24. It should be understood that the position of the peak of the crown 41 along the length L of the eccentric pin 24 may be positioned as close to the distal end 34 of the eccentric pin 24 as possible while still maintaining enough space for the eccentric pin 24 to properly engage the slider block 26. The closer the contact area 40 is moved toward the distal end 34, the greater the stress on the eccentric pin 24. Therefore, the actual position of the peak of the crown 41 along the length of the drive surface 38 depends on application specific parameters that include the size and strength of the eccentric pin 24. A preferred range of the peak of the crown 41 is at 70%-90% of the length L from the base end 32 of the eccentric pin 24

The present invention improves upon the prior art by moving the contact area 40 of the drive surface 38 closer to the distal end 34 of the eccentric pin 24. As a result, the drive force X is moved closer to a gas force Y (FIG. 4) caused by the compression of a fluid between the spiral wraps 15 and 17 of the orbiting scroll member 16 and the non-orbiting scroll member 18. As a result, the size of a tipping moment Z (caused by the opposing drive force X and gas force Y) experienced by the orbiting scroll member 16 during operation of the scroll compressor 10 is decreased. Therefore, the stability of the orbiting scroll member 16 is improved and the desired increase in efficiency of the scroll compressor 10 is achieved.

While it has been disclosed that the crown 41 of the contact area 40 is located along the length L of the eccentric pin 24, it is also possible to position the crown 41 along a length of the slider block 26.

The foregoing shall be interpreted as illustrative and not in a limiting sense. A worker of ordinary skill in the art would recognize that certain modifications would come within the scope of this invention. For that reason, the following claims should be studied to determine the true scope and content of this invention.

What is claimed is:

1. A scroll compressor assembly, comprising:

a first scroll member;

a second scroll member cooperating with said first scroll member to define compression chambers;

a boss extending from said first scroll member to receive a slider block; and an eccentric pin driving said slider block to cause said first scroll member to orbit relative to said second scroll member, wherein said eccentric pin has a length extending from a base end to a distal end, one of said eccentric pin and said slider block including a contact area having a crown that engages the other of said eccentric pin and said slider block, wherein a peak of said crown is positioned at least at a distance greater than 62% of said length from said base end of said eccentric pin.

2. The assembly as recited in claim 1, wherein said first and second scroll members each include a base portion and a spiral wrap extending from said base portion.

3. The assembly as recited in claim 2, wherein said spiral wraps of said first and second scroll members interfit with each other to define said compression chambers.

4. The assembly as recited in claim 1, including a shaft that supports said eccentric pin, said shaft having a shoulder portion at said base end.

5. The assembly as recited in claim 4, wherein said base end of said eccentric pin has a smaller cross-sectional area than said shaft.

6. The assembly as recited in claim 1, wherein said peak of said crown is positioned at 70% to 90% of said length from said base end of said eccentric pin.

7. The assembly as recited in claim 6, wherein said peak of said crown is positioned at least at a distance of 75% of said length from said base end of said eccentric pin.

8. The assembly as recited in claim 1, wherein said length includes a flat drive surface.

9. The assembly as recited in claim 8, wherein said contact area is located on said flat drive surface, said contact area defining a single line contact between said eccentric pin and said slider block.

10. The assembly as recited in claim 1, wherein said crown is positioned on said eccentric pin.

* * * * *